US009885543B2

(12) United States Patent
Cannon

(10) Patent No.: US 9,885,543 B2
(45) Date of Patent: Feb. 6, 2018

(54) MECHANICALLY-ADAPTIVE, ARMOR LINK/LINKAGE (MAAL)

(71) Applicant: Joseph P. Cannon, Lenox, MI (US)

(72) Inventor: Joseph P. Cannon, Lenox, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 14/872,174

(22) Filed: Oct. 1, 2015

(65) Prior Publication Data

US 2017/0097211 A1 Apr. 6, 2017

(51) Int. Cl.

| | |
|---|---|
| ***F41H 5/007*** | (2006.01) |
| ***F41H 5/16*** | (2006.01) |
| ***F41H 5/24*** | (2006.01) |
| ***F41H 5/02*** | (2006.01) |

(52) U.S. Cl.

CPC ..... *F41H 5/007* (2013.01); *F41H 5/026* (2013.01); *F41H 5/16* (2013.01); *F41H 5/24* (2013.01)

(58) Field of Classification Search

CPC . F41H 5/007; F41H 5/026; F41H 5/16; F41H 5/24; F41H 5/02; F41H 5/0442; F41H 5/045

USPC ..... 89/36.03, 36.04–36.07, 36.01–36.02; 428/911

See application file for complete search history.

(56) References Cited

U.S. PATENT DOCUMENTS

| | | | | |
|---|---|---|---|---|
| 661,201 A | | 11/1900 | Wilding | |
| 746,722 A | | 12/1903 | Mahler | |
| 1,086,708 A | * | 2/1914 | Hoagland | F42D 5/045 109/49.5 |
| 1,119,200 A | | 12/1914 | Stofa | |
| 1,166,460 A | | 1/1916 | Hughes | |
| 1,223,536 A | * | 4/1917 | Travelstead | B63G 9/04 114/240 B |
| 1,225,461 A | | 5/1917 | McCarthy | |
| 1,376,304 A | | 4/1921 | Zeglen | |

(Continued)

FOREIGN PATENT DOCUMENTS

| | | | | |
|---|---|---|---|---|
| GB | 535638 A | * | 4/1941 | F41H 5/02 |
| GB | 535638 A | * | 4/1941 | F41H 5/02 |
| WO | WO 2011/057628 | | 5/2011 | |

OTHER PUBLICATIONS

Rear view of a Merkava Mk 2 (intrbduced 1983) with chains protecting the turret ring area.

*Primary Examiner* — John Cooper

(74) *Attorney, Agent, or Firm* — Gary A. Smith; Thomas W. Saur

(57) ABSTRACT

An armor system and method for the protection of an environment. The armor system includes at least one, and generally a plurality of flexible strands, a first strand support system, and a control subsystem. The control subsystem is configured to manually or automatically adapt the configuration of the armor system in response to a ballistic threat. The armor system may further include at least one of a drift gap and a spall catcher positioned between the flexible strand and the environment to be protected. The configuration can include activating a wave shape along the flexible strand. The configuration can include multiple layers of the flexible strands. The flexible strands may be implemented as a curtain. The strands may be deployed into an open-top container.

14 Claims, 10 Drawing Sheets

(56) References Cited

U.S. PATENT DOCUMENTS 1,410,820 A 3/1922 McMillan, Jr.
1,418,995 A * 6/1922 Wallace ..... F41H 5/045 109/49.5
1,490,296 A 4/1924 Swanson
1,994,840 A 3/1935 Thoen
2,037,458 A 4/1936 Cornell et al.
2,182,461 A 12/1939 Yeakel
2,625,859 A 1/1953 Dandini
2,635,307 A 4/1953 Wood
2,723,214 A 11/1955 Meyer
2,871,763 A 2/1959 Blomquist
3,416,051 A 12/1968 Pinto et al.
3,575,786 A 4/1971 Baker et al.
3,586,236 A * 6/1971 Schaffler ..... A62C 27/00 169/48
3,590,685 A 7/1971 Lane
3,776,094 A 12/1973 Gilles et al.
3,813,281 A 5/1974 Burgess et al.
3,893,368 A 7/1975 Wales, Jr.
3,983,832 A 10/1976 Kinder
4,009,638 A 3/1977 Ramseyer et al.
4,058,021 A 11/1977 Wood
4,356,569 A 11/1982 Sullivan
4,358,984 A 11/1982 Winblad
4,364,300 A 12/1982 Pagano et al.
4,383,585 A 5/1983 Gaus
4,398,446 A 8/1983 Pagano et al.
4,524,674 A 6/1985 Gilvydis
4,526,828 A 7/1985 Fogt et al.
4,529,640 A 7/1985 Brown et al.
4,580,073 A 4/1986 Okumura et al.
4,741,244 A 5/1988 Ratner et al.
4,752,970 A 6/1988 Arakaki
5,149,910 A 9/1992 McKee
5,183,119 A 2/1993 Wattenburg
5,293,806 A 3/1994 Gonzalez
5,402,704 A 4/1995 Donovan
5,431,082 A * 7/1995 Zelverte ..... F41H 11/28 89/1.13
5,435,195 A 7/1995 Meier
5,482,365 A 1/1996 Peterson et al.
5,533,781 A 7/1996 Williams
5,576,508 A 11/1996 Korpi
5,577,432 A 11/1996 Becker et al.
5,738,925 A 4/1998 Chaput
5,747,721 A 5/1998 Speakes et al.
5,804,757 A 9/1998 Wynne
5,866,839 A 2/1999 Ohayon
5,915,449 A * 6/1999 Schwartz ..... A47H 13/00 160/330
6,080,493 A 6/2000 Kent
6,112,635 A 9/2000 Cohen
6,161,462 A 12/2000 Michaelson
6,240,997 B1 6/2001 Lee
6,374,897 B1 4/2002 Liu
6,460,945 B2 10/2002 Takeno et al.
6,588,705 B1 * 7/2003 Frank ..... B64C 1/1469 244/118.5
6,622,608 B1 9/2003 Faul et al.
6,681,679 B2 1/2004 Vives et al.
6,782,793 B1 8/2004 Lloyd
7,059,236 B2 6/2006 Gonzalez
7,077,048 B1 7/2006 Anderson, Jr. et al.
7,152,517 B1 12/2006 Ivey
7,261,945 B2 8/2007 Biermann et al.
7,609,156 B2 10/2009 Mullen
7,698,984 B2 4/2010 LaBrash et al.
7,736,561 B2 6/2010 Tam et al.
7,827,900 B2 11/2010 Beach et al.
7,866,250 B2 1/2011 Farinella et al.
7,946,211 B1 5/2011 Winchester et al.
7,987,762 B2 8/2011 Joynt et al.
8,021,020 B2 * 9/2011 Costello ..... D03D 9/00 362/249.06
8,033,208 B2 10/2011 Joynt et al.
8,037,804 B1 10/2011 Wahlquist
8,098,191 B1 1/2012 Pergande et al.
8,132,495 B2 3/2012 Joynt
8,151,685 B2 4/2012 Joynt
8,226,873 B1 7/2012 Martin et al.
8,297,170 B2 10/2012 Diller et al.
8,316,752 B2 11/2012 Waddell, Jr. et al.
8,402,876 B2 3/2013 Cohen
8,424,443 B2 4/2013 Gonzalez
8,450,593 B2 5/2013 Ierymenko et al.
8,453,553 B2 6/2013 Cannon
8,622,858 B2 1/2014 Huang
8,863,633 B2 10/2014 Gotie
9,335,140 B2 * 5/2016 Mitchell ..... F41H 5/026
2003/0127122 A1 * 7/2003 Gower ..... F41H 5/24 135/87
2006/0048641 A1 * 3/2006 Gonzalez ..... F41H 7/042 89/36.08
2006/0162538 A1 7/2006 Pfennig et al.
2006/0202492 A1 9/2006 Barvosa-Carter et al.
2007/0180983 A1 * 8/2007 Farinella ..... F41H 11/02 89/36.07
2009/0308238 A1 * 12/2009 Schwartz ..... F41H 5/026 89/36.02
2010/0294124 A1 * 11/2010 Wentzel ..... F41H 11/02 89/36.02
2012/0011993 A1 * 1/2012 Malone ..... F41H 5/013 89/36.02
2012/0097018 A1 * 4/2012 Schoenheit ..... F41H 5/0442 89/36.02
2012/0152101 A1 * 6/2012 Engleman ..... F41H 5/026 89/36.08
2013/0186264 A1 * 7/2013 Errington ..... E06B 9/01 89/36.04
2013/0200236 A1 * 8/2013 Wood ..... F16M 13/02 248/291.1
2014/0260937 A1 9/2014 Whitaker

* cited by examiner

MECHANICALLY-ADAPTIVE, ARMOR LINK/LINKAGE (MAAL)

GOVERNMENT INTEREST

The inventions described herein may be made, used, or licensed by or for the U.S. Government for U.S. Government purposes without payment of royalties to me.

CROSS-REFERENCE TO RELATED APPLICATIONS

None

STATEMENT REGARDING PRIOR DISCLOSURES BY AN INVENTOR OR JOINT INVENTOR

None

BACKGROUND OF THE INVENTION

1. Field of the Invention

The present invention generally relates to armor, and in particular, to a Mechanically-Adaptive, Armor Link/linkage (MAAL) armor system.

2. Description of Related Art

Conventional passive and mechanically reactive armor structures and systems that are configured to defeat projectile and/or other threats that have been implemented with varying degrees of success. A significant amount of the prior art in the armor area is in connection with human body armor, and does not use linked armor components at the cellular and modular level. Much of the prior art for use in vehicular armor enhancement is of fixed manufacture design, and is statically unchangeable once produced and integrated into and/or onto the vehicle.

However, conventional armor generally presents deficiencies, compromises and limitations in performance, which are often manifested as inadequate performance against threats and/or producing potential hazard to nearby individuals and/or equipment, excessive weight and size, collateral damage to personnel and/or the environment, inability to transport vehicles equipped with the armor, simple hence limited response capabilities, and the like. In many cases, conventional armors are ineffective for defeating some threats. As such, there is a desire for improved armor systems.

SUMMARY OF THE INVENTION

Accordingly, the present invention may provide an improved apparatus and system for armor. According to the present invention, a system for Mechanically-Adaptive, Armor Link/linkage (MAAL) armor is provided.

The MAAL armor system generally provides enhanced passive armor ballistic protection through passive dynamic deflection and ability to accumulate mass at the point of threat impact on the armor strike-face. Additionally the MAAL armor system generally causes a yaw effect on ballistic threats because of reactive tension in the MAAL armor strands upon the threat and after impact with the threat. Because of adaptive variability in the fundamental link structure, the MAAL armor also can be implemented through numerous embodiments as described in detail below and shown on the Figures. For example, links and strands can be overlapped and configured in numerous different schemes and orientations which suit the operational need to defeat various threats that can be encountered. Due to the MAAL armor system variability, and ease of adaptation, the MAAL armor system can be used for situations where modification (e.g., disruption, alteration, etc.) of the threat trajectory is desired. Thus due to the features of the MAAL armor system, use of the MAAL armor system for enhancement of armor is generally inherently much more modifiable, adaptable, and designable (e.g., configurable) for use in many different threat situations and ballistic protection applications.

The MAAL armor system can be topographical adaptable. The topographical adaptability of the MAAL armor system generally provides for modification, as required, to suit various and numerous operational situations and/or needs. Different applications of the MAAL armor system include the use of various mounting and attachment structures at various areas of the vehicle and/or structure (i.e., environment) where implemented. For example, these attachment and mounting schemes can be varied, adjustable, and dimensionally tractable and conformable to accommodate the threat hazards as well as the environment where implemented. The MAAL armor system adaptive topography allows for configuration for use as and/or with bar/net type armor and signature heat management, and potential mitigation of RPG threats. The topographical adaptability of MAAL provides the capability to be modified as required to suit various and numerous operational needs.

The MAAL armor system generally provides:

- Ease of manufacturability.
- Ease of ballistic armor enhancement scalability.
- Ability for different armor material integration.
- Ability for modular armor material integration.
- Ability for appliqué and coating enhancement to standard links/linkages and shafts.
- Multiple compound implementation (e.g., ceramic, metallic, composite, etc. composition).
- Dimensional scalability at the link and the strand level to suit operational needs.
- Passive mass accumulation at the point/points of threat impact.
- Passive dynamic deflection for increase of armor ballistic limits.
- Yaw and tumble effects on ballistic projectiles to alter their trajectory/path yaw orientation.
- Significant diminishment of threat ballistic performance.
- Easy orientation in multiple different configurations to suit operational needs.
- Capability for overlapped, doubled/tripled/etc. up installation to increase strike-face topography for increased ballistic performance.
- Capability for differing orientations to provide multiple angular strike-faces for increased ballistic performance and adaptability to different threats as seen on the battle field.
- Improved heat signature management when compared to conventional armor implementations.
- Capability to provide underbody impulse dissipation (such as IED blasts) because of the MAAL armor system passive dynamic deflection capabilities. The MAAL armor system generally produces a damping effect because of the increasing amount of links/linkages that are involved (e.g., drawn into play, effected, and the like) as the incident blast severity increases.

The present invention may provide an armor system for the protection of an environment. The armor system including at least one flexible strand. The flexible strand may Include a first end, a second end, and a strike face. The armor system also includes a first strand support subsystem that is mounted to the environment. The first strand support subsystem generally retains the first end of the strand, and the flexible strand is configured to intercept a ballistic threat at the strike face.

The armor system may further include at least one of a drift gap and a spall catcher positioned between the flexible strand and an environment where the armor system is implemented.

The flexible strand may be implemented as at least one of a roller, leaf, or hinge link chain or a flexible belt having at least one armor plate that is attached to the flexible belt.

The armor system may further include a second strand support subsystem that is mounted to the environment. The second strand support subsystem generally retains the second end of the flexible strand. The strike face may include an armor plate that is attached to the flexible strand.

The armor system may further include a control subsystem that is coupled to the first strand support subsystem and/or the second strand support subsystem. The control subsystem is generally configured to manually or automatically adapt the configuration of the armor system in response to the ballistic threat. The configuration may include activating a wave shape along the flexible strand.

The armor system may further include at least one of an idler pulley and a spool mounted to the environment, and the flexible strand may be looped to present two or more layers to the threat.

The armor system may further include at least one of an idler pulley and a spool mounted to the environment, and an open-top container mounted to the environment. The open-top container has a closed bottom, an open top region, and an internal box thickness. The flexible strand is deployed into the open-top container via the open top region, and when the second end of the flexible strand encounters the closed bottom, the flexible strand folds upon itself to an accordion shape as constrained by the internal box thickness.

The present invention may also provide a method for defeating a ballistic threat. The method generally includes attaching a first strand support subsystem to an environment to be protected, and retaining at least one flexible strand at a first end of the flexible strand using the first strand support subsystem to provide an armor system. The flexible strand generally includes a second end, and a strike face. The flexible strand is generally configured to intercept a ballistic threat at the strike face.

The armor system used by the method may further include at least one of a drift gap and a spall catcher positioned between the flexible strand and the environment.

The flexible strand may be implemented as at least one of a roller, leaf, or hinge link chain or a flexible belt having at least one armor plate that is attached to the flexible belt.

The armor system used by the method may further include a second strand support subsystem mounted to the environment, and the second strand support subsystem generally retains the second end of the flexible strand. The strike face may include an armor plate that is attached to the flexible strand.

The armor system used by the method may further include a control subsystem that is coupled to the first strand support subsystem and/or the second strand support subsystem. The control subsystem is generally configured to manually or automatically adapt the configuration of the armor system in response to the ballistic threat. The configuration may include activating a wave shape along the flexible strand.

The armor system used by the method may further include at least one of an idler pulley and a spool mounted to the environment, and the flexible strand may be looped to present two or more layers to the threat.

The armor system used by the method may further include at least one of an idler pulley and a spool mounted to the environment, and an open-top container mounted to the environment. The open-top container has a closed bottom, an open top region, and an internal box thickness. The flexible strand is deployed into the open-top container via the open top region, and when the second end of the flexible strand encounters the closed bottom, the flexible strand folds upon itself to an accordion shape as constrained by the internal box thickness.

The above features, and other features and advantages of the present invention are readily apparent from the following detailed descriptions thereof when taken in connection with the accompanying drawings.

BRIEF DESCRIPTION OF THE DRAWINGS

FIG. 8 is an edge view from the front towards the rear of the armor system of FIG. 1 of the;

DETAILED DESCRIPTION OF THE PREFERRED EMBODIMENT(S)

Definitions and Terminology

Figure 1:
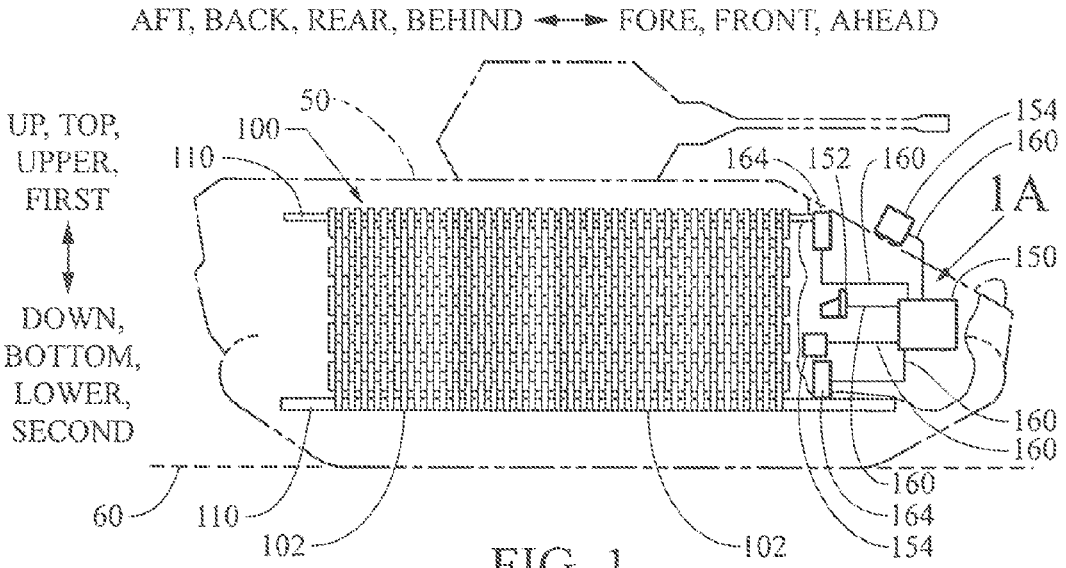
FIG. 1 is a right side elevation view that illustrates an embodiment of a Mechanically-Adaptive Armor Link/Linkage (MAAL) armor system implemented in connection with a vehicle, and with a cutout FIG. 1A that illustrates a portion of the armor system that is generally implemented in a region internal to the vehicle.

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, characteristic, parameter, and the like, refer to an amount that is sufficient to provide an effect that the material or characteristic was intended to provide as understood by one skilled in the art. The amount of variation generally depends on the specific implementation. Similarly, "substantially free of" or the like refers to the lack of an identified composition, characteristic, or property. Particularly, assemblies that are identified as being "substantially free of" are either completely absent of the characteristic, or the characteristic is present only in values which are small enough that no meaningful effect on the desired results is generated. The composition, manufacture, and source of an armor material such as steel, titanium, aluminum, composite, cermet, ceramic, and the like is assumed to be known to one of skill in the art.

A plurality of items, structural elements, compositional elements, materials, subassemblies, and the like may be presented in a common list or table for convenience. However, these lists or tables should be construed as though each member of the list is individually identified as a separate and unique member. As such, no individual member of such list should be considered a de facto equivalent of any other member of the same list solely based on the presentation in a common group so specifically described.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

As used herein, elements having numbers more than 49 and less than 100 generally refer to conventional elements known in the art by one having ordinary skill with respect to armor and armor systems and methods, and the like; generally active and passive armor; while elements number 100 and above refer to the present invention, or elements, components, and the like thereof. Like numbered elements generally refer to the same element; however, the like numbered elements may include a suffix "L" to designate the left side element and a suffix "R" to designate the right side element when left and right elements are mirrors of each other. Likewise, for similar elements that are implemented in locations at or near the top of the environment, a suffix "T" may be implemented to designate and distinguish from the element implemented in locations at or near the bottom of the environment which may include the suffix "B". Alternative embodiments of an element that retain similar characteristics may also be designated via a "prime" (i.e., ') symbol.

One of skill in the art is assumed to have knowledge of the general physical properties and manufacture of the components described below. Where deemed appropriate, teachings of issued U.S. patents and/or published patent applications are noted and incorporated by reference in their entirety. As would be understood and appreciated by one of skill in the art, elements may be omitted from some Figures and/or views for clarity of illustration without diminishing the patentability of the present invention.

Conventional elements (numbered between 50 and 99) include:

50: an armored personnel carrier vehicle, tank, armored transport, or vehicle generally;

60: ground plane, operational surface (i.e., not necessarily horizontal), etc.;

70: ballistic threat, projectile, blast ejecta/particles, bullet, blast wave, fragment, segmented rounds, fluid metals, penetrating jets ("thorns", "spikes", etc.) as generated by chemical energy rounds, high energy kinetic rounds, and the like;

Elements (numbered 100 and above, and including English and Greek alphabetical characters) of and/or pertaining to the present invention may include but are not necessarily included in all embodiments and are not limited to:

100: Mechanically-Adaptive, Armor Link/linkage (MAAL) armor system (apparatus, device, assembly, part, mechanism, and the like);

102 (and 102'): strand (roller, leaf, or hinge link strand, chain, tendril, string, line, belt, course, hinge joint belt, cog belt, strap, band, ribbon, and the like), and/or curtain (mat, screen, blanket, matrix, group, flap, and the like);

104: link (plate, block, platen, etc.);

106: connector rod (axle, pin, shaft, bar, and the like);

108: connector hole (passage hole, axle bore, aperture, bore, void, etc.);

110: hanger subsystem (support, retainer, holder, mounting subassembly, retaining subsystem, etc.);

120: control subsystem;

150: controller (e.g., processor, computer, etc.);

152: user operated input/output and display console;

154: detectors (sensors);

156: actuator subsystem (mechanism, device, apparatus, etc.);

160: connector subsystem (e.g., link, path, conduit, interconnect, wire, cable, tubing, fiber, etc.);

164: actuator driver (e.g., rotor motor, linear motor, hydraulic or pneumatic cylinder, screw drive, and the like);

166: operating linkage (e.g., assembly, apparatus, device, mechanism, lever, extension, beam, etc.);

170: impact appliqué (tile, plate, block, etc.);

174: drift gap;

176: spall catcher (liner);

180: idler (or tensioning) pulley (roller, slide channel, sheave, guide, etc.);
184: spool (spooling mechanism, reel, load/unload cog set, and the like);
186: hanger (hook, retainer);
190: open-top container (box, vault, bin, etc.);
192: bottom (i.e., closure) of the container 190;
194: top (open) region of the container 190;
BT: internal box thickness, i.e., the lateral thickness of the container 190;
F: flexation separation distance between successive instances of the plate 170;
L: overall length of a link 104;
LC: center-to-center length between pivot connector holes 108 in a link 104;
R: angular motion of a link 104 about an axle 106;
S: separation, clearance between adjacent strands 102;
T: thickness of a link 104;
WI: width of a link 104 at its widest region, generally across a connector hole 108;
WO: width of a link 104 at its most narrow region;
X: linear displacement (range of motion) of the operating linkage 166 and/or other elements that comprise the hanger subassembly 110;
φ: angular motion of the operating linkage 166 and/or other elements of the hanger subassembly 110;
θ: angular motion of the strand 102 about a horizontal axis; and
ω: angular motion of the strand 102 about a vertical axis.

With reference to the Figures, the preferred embodiments of the present invention will now be described in detail. Generally, the present invention provides an improved system and method for armor. In particular, a system and method for a Mechanically-Adaptive Armor Link/Linkage (MAAL) armor 100 is generally provided. Structures that may be protected by a reactive armor according to the present invention are vehicles such as tanks, armored personnel carriers, armored fighting vehicles; armored static structures such as buildings, above-ground portions of bunkers or shelters, containers for the storage of water, fuel, chemicals, munitions; and the like. The environment in which the MAAL armor system is implemented forms no part of the invention. The armor system and method according to the present invention may be implemented as standalone armor, or alternatively may be implemented in connection with (e.g., integrated with) conventional passive armor and/or conventional active/reactive armor.

The Mechanically-Adaptive Armor Link/Linkage (MAAL) armor system 100 generally provides enhanced passive armor ballistic protection through passive dynamic deflection, and the ability to accumulate mass at the point of threat impact on the strike-face of the armor. Additionally the MAAL armor system 100 may create a yaw and/or tumble effect on ballistic threats because of reactive tension in the MAAL armor 100 strands upon and after Impact. The MAAL armor system 100 can be realized (implemented) through numerous embodiments as described below and shown on the included Figures, through adaptive variability in the fundamental link/strand structure. For example, links and strands of the system 100 can be overlapped, scaled and configured in numerous different schemes and orientations which suit the operational need to overcome various threats or accommodate situations that can be encountered.

For example, in the MAAL armor system 100, the mail links are linearly constrained, and supplemental MAAL armor 100 strand lengths are stored, spooled, overlapped, and can be progressively scaled to increase the threat protection level. The MAAL armor system 100 can serve as the primary armor protection system, where as some conventional armor techniques are secondary mitigation schemes to prevent thrown objects from getting tossed or lodged between the hull and the turret of a military vehicle.

Referring to FIG. 1, a right side elevation view of the armor mechanism (e.g., apparatus, device, system, assembly, subassembly, etc.) 100 is shown. In one embodiment, the armor system 100 generally comprises at least one of the roller, leaf, or hinge, and/or the like link strand 102 (and/or roller link curtain 102) or a combination thereof, the first support (retaining, mounting) subsystem 110, and the control subsystem (assembly) 120. Throughout the description, the term roller, leaf, or hinge link strand 102 may refer to a single strand having any length and width, multiple strands each having any length and width, a curtain, or any combination thereof. In another embodiment as described below in connection with FIGS. 10 and 11, the strand 102 may comprise a fabric belt.

In any case, the strand 102 is generally configured as a flexible belt (strand) that provides enhanced passive armor ballistic protection through passive dynamic deflection, and the ability to accumulate mass at the point of the threat 70 impact on the strike face of the armor 100. The strand/curtain 102 is generally a threat disruptor (e.g., disrupts the threat 70). Additionally the MAAL armor system 100 generally creates a yaw and/or tumble effect on the ballistic threat 70 because of reactive tension in the MAAL armor 100 strands 102 upon and after impact from the threat 70. The roller, leaf, or hinge link strand 102 has a first end that is generally retained via the first hanger support subsystem 110. As illustrated on FIG. 1, the armor system 100 may further comprise the second support subsystem 110. The strand 102 has a second end that is may be free hanging, or alternatively, may be retained via the second hanger support (retaining, mounting) subsystem 110. As describe below in connection with FIG. 13, the strand 102 may have additional length that is kept on, and extended and retracted from the spool 184.

As an example of one embodiment of the armor system 100, on FIG. 1 the integrated MAAL armor system 100 is shown mounted on the right hull side of the armored personnel carrier (vehicle) 50. However, the system 100 can generally be integrated in connection with any vehicle or structure where ballistic protection is desired. The vehicle 50 is illustrated resting on the ground plane, 60. For the vehicle 50, and the system 100 mounted on or used in connection with the vehicle 50, forward/reverse (longitudinal), lateral (left/right), and vertical (up/down) directions are generally relative to the vehicle 50 and the armor system 100 as typically operated (e.g., when the vehicle 50 is operated via an included powertrain in a forward/reverse, left/right mode). As such, lateral (left/right) directions are generally perpendicular to the longitudinal/vertical plane, and are referenced from the perspective of the typical mode of operation of the vehicle 50 by a user (e.g., driver, operator). A first longitudinal direction (e.g., forward/outward/up) and a second longitudinal direction (e.g., rearward (or reverse)/inward/down) where the second direction substantially, but not necessarily wholly, opposes the first direction are also generally or used in connection with the vehicle 50. Similarly, the first lateral and vertical directions generally, but not necessarily, wholly oppose the second lateral and vertical directions. Referenced directions are generally as shown on FIG. 1 unless otherwise noted.

The roller, leaf, or hinge and the like link strand 102 (and/or roller, leaf, or hinge and the like link curtain 102)

may be suspended vertically via the first hanger support subsystem 110. When supported via the first hanger support subsystem 110, the roller link strand 102 is generally substantially vertically hanging until impacted by the threat 70. The second hanger support subsystem 110 may be implemented to provide additional support and/or adaptation capability to the roller, leaf, or hinge and the like link strand 102. While not specifically Illustrated, as would be understood by one of skill in the art armor protection may be implemented on all surfaces of the vehicle 50. As such, the strand 102 may be implemented horizontally (e.g., over the top of and/or underneath the vehicle 50) or at an angle other than directly vertical (e.g., disposed parallel to a V-shaped vehicle hull) to meet the design criteria of a particular application. Such implementations will generally include the first hanger support subsystem 110 and the second hanger support subsystem 110.

Referring to FIG. 1A, a cutout of the vehicle 50 illustrating the control system 120 is shown. The control system (e.g., subsystem, assembly, apparatus, etc.) 120 generally includes the controller 150, the user operated input/output and display console 152, one or more of the detectors 154, at least one actuator subsystem 156, and the connector subsystem 160. The detectors 154 are generally implemented at and/or on or near the outer surface of the vehicle 50.

The controller 150 generally includes appropriate software to control (e.g., manage, implement, operate) the adaptable configurations of the armor system 100. As described in more detail below in connection with FIGS. 13, 14, and 15(A-H), the user may manually operate the control system 120 to adjust the configuration of the armor system 100 via the user operated input/output and display console 152. Further, the control subsystem 120, generally automatically, dynamically, in real time adjusts the configuration of the armor system 100 in response to the threat 70 as detected via the sensors 154 via controlled movement of the actuator subsystem 156. The actuator subsystem 156 is generally mechanically (including hydraulically and/or pneumatically) and/or electrically coupled to the first hanger support subsystem 110, and to the second hanger support subsystem 110, when implemented.

The connector subsystem 160 generally provides electrical communication (e.g., power and/or signals) between the controller 150 and the input/output and display console 152 (i.e., to electrically couple the controller 150 to the input/output and display console 152), the controller 150 and the detectors 154 (i.e., to electrically couple the controller 150 to the detectors 154); and between the controller 150 and the actuator subsystems 156 (i.e., to electrically couple the controller 150 to the actuator subsystems 156). However, other communication, control, and/or activation (e.g., mechanical, magnetic, hydraulic, pneumatic, and the like) may also be implemented in the armor system 100, as would be known to one of skill in the art.

The control assembly 120 may include real time, automatically performing (e.g., computer controlled), sensor equipped threat detection and response activation. Examples of conventional sensor equipped threat detection and response action apparatuses that may be implemented in connection with the control assembly 120 may be found in U.S. Pat. No. 3,893,368, issued Jul. 8, 1975 to Wales, Jr.; U.S. Pat. No. 6,622,608, issued Sep. 23, 2003 to Faul, et al.; U.S. Pat. No. 6,681,679, issued Jan. 27, 2004 to Vives et al.; U.S. Pat. No. 7,827,900, issued Nov. 9, 2010 to Beach et al.; and U.S. Pat. No. 7,866,250, issued Jan. 11, 2011 to Farinella et al., all of which are incorporated by reference in their entirety; however, the sensor equipped threat detection and response action subsystem of the control system 120 may be implemented via any appropriate apparatus to meet the design criteria of a particular application as would be known to one of skill in the art.

The hanger subsystem 110 may include but is not limited to one or more of the elements: the actuator subsystem 156; the actuator driver 164; the operating linkage 166; the idler 180; the spool 184; and the hanger 186.

Figure 2:
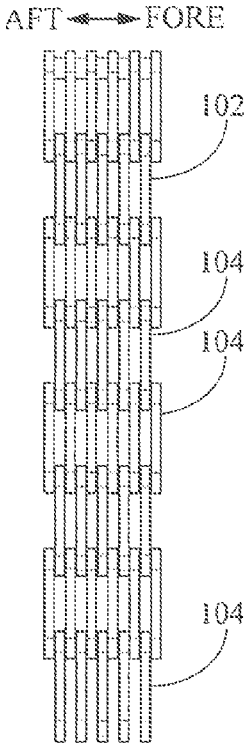
FIG. 2 is a right side elevation view that illustrates an individual strand of the armor system of FIG. 1.
Figure 3:
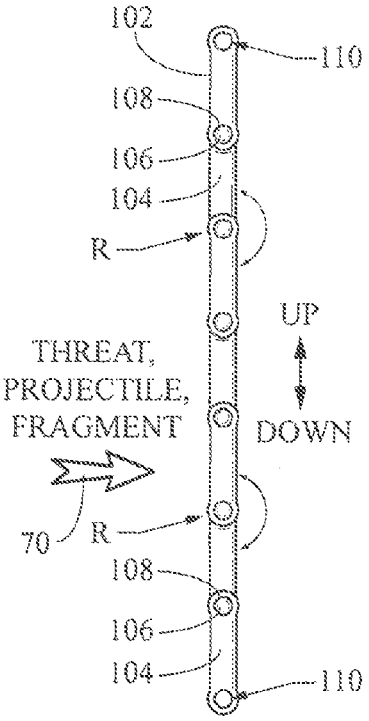
FIG. 3 is an edge view from the front towards the rear of the armor system of FIG. 1.

Referring to FIGS. 2 and 3, FIG. 2 is a side view that illustrates the strand 102 of FIG. 1 as installed hanging substantially vertically on the right side of the vehicle 50. FIG. 3 is an edge (i.e., rearward facing) view of the strand 102 of FIG. 1. On FIGS. 2 and 3, in particular, and on all Figures generally, certain details have been omitted for clarity of illustration and description. The armor system 100 is generally implemented to defeat and/or reduce the deleterious effects of one or more of the threats 70. On FIG. 3, the threat 70 is illustrated approaching the strand 102. As such, the edge of the link 104 impacted by the threat 70 is a strike face.

The strand (or curtain) 102 comprises a plurality of links 104 having pivot connector holes 108 at each end, wherein the plurality of links 104 are interconnected via a plurality of rods 106 as is illustrated and described, for example, in U.S. Pat. No. 746,722, issued Dec. 15, 1903 to Mahler, especially at claim 7; U.S. Pat. No. 2,635,307, issued Apr. 21, 1953 to Wood, especially at claims 1 and 3; U.S. Pat. No. 4,058,021, issued Nov. 15, 1977 to Wood; U.S. Pat. No. 8,622,858, issued January 2014 to Huang, all of which patents are incorporated by reference in their entirety. At each interconnection having the axle (rod) 106 and the hole 108 generally defines a revolute joint (hinge joint) R. As described in more detail below, the armor system 100 generally defeats the threat 70 by absorbing the impact of the threat 70 on the strand 102 through rotation of one or more of the joints R. The links 104 are generally linearly constrained such that substantially all of the movement of the strands 102 is manifested rotationally (e.g., about the axle 106), laterally (left/right), and/or vertically (u/down), and not longitudinally (fore/aft) when viewed as Illustrated on FIG. 1.

Figure 4:
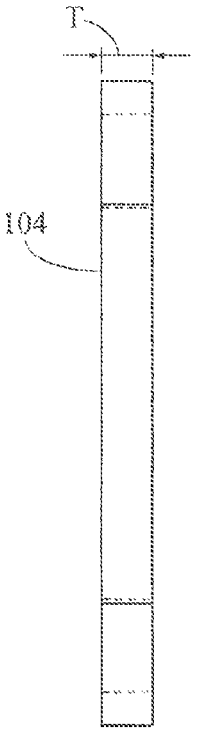
FIG. 4 is a side of an individual link of the armor system of FIG. 1.
Figure 5:
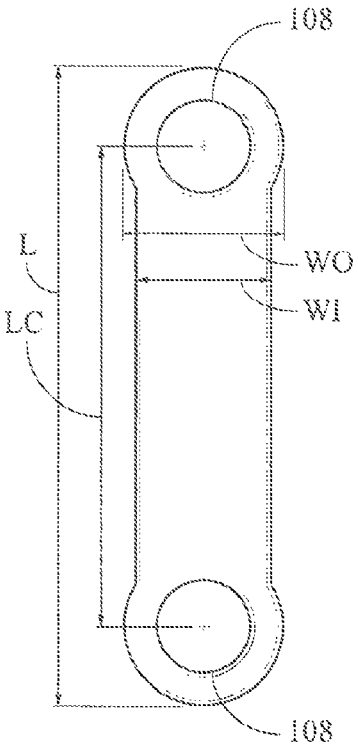
FIG. 5 is an edge view from the front towards the rear of the armor system of FIG. 1.

Referring to FIGS. 4 and 5, side and end views, respectively, of an individual link 104 are shown. FIG. 4 illustrates the thickness, T, of the link 104. Referring to FIG. 5, the connector holes 108 at first and second ends of the link 104 are illustrated. Likewise, the overall length of the link 104; the center-to-center length between pivot connector holes 108, LC, in the link 104; the width of the link 104 at its widest region, WI; and the width of the link 104 at its most narrow region, WO, are illustrated.

Figure 6:
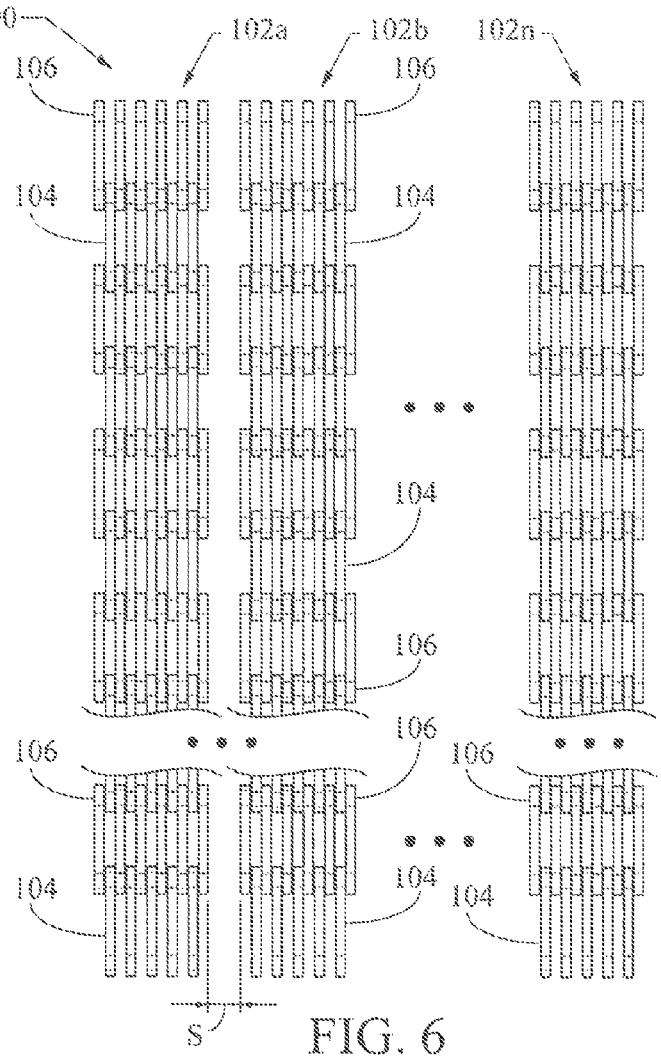
FIG. 6 is a right side elevation view that illustrates a multi-strand alternative embodiment of the armor system of FIG. 1.

FIG. 6 is another side view that illustrates the curtain 102 (e.g., a plurality of strands 102*a*,102*b*, . . . , 102*n*), wherein the strands 102 are separated by the distance S. The separation S is generally equal to or less than the thickness T. The number of links 104 that are connected laterally/longitudinally and/or vertically via the rods 106 to form the strand (or curtain) 102 is generally selected (chosen, determined, etc.) to defeat the anticipated threat 70, in connection with the environment 50 where the MAAL armor system 100 is implemented (e.g., available space, amount of area where protection is desired, number of repeated threats anticipated, weight considerations, etc.), and other appropriate, relevant design parameters as would be considered by one of skill in the art.

The links 104 may be implemented with geometry that is solid, or, alternatively, hollow, ribbed, or channeled. The links 104 may be manufactured from an armor material such as steel, titanium, aluminum, composite, cermet, ceramic, and the like. Alternatively, the links 104 may be implemented as a combination of geometries and/or materials listed above.

The axles 106 may be implemented with geometry that is solid, or, alternatively, hollow. The axles 106 may be manufactured from an armor material such as steel, titanium, aluminum, composite, cermet, ceramic, and the like. Alternatively, the axles 106 may be implemented as a combination of geometries and/or materials listed above.

Figure 7:
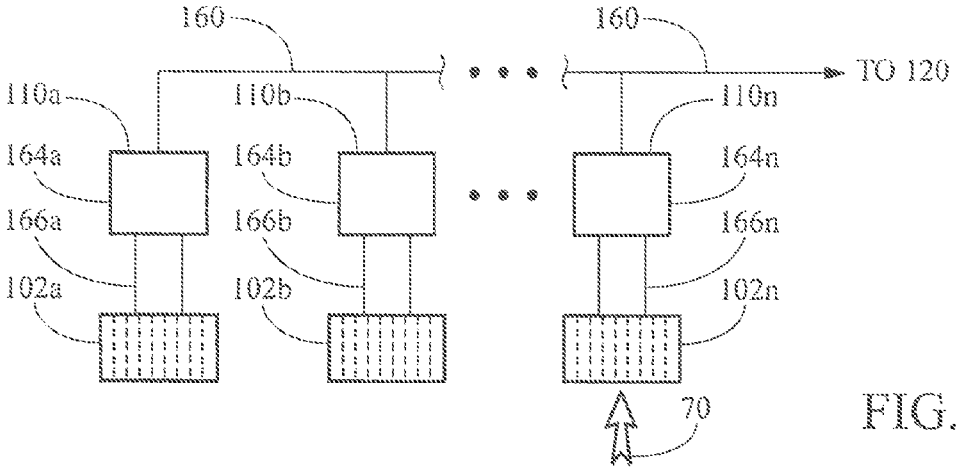
FIG. 7 is a top plan view illustrating a portion of the armor system of FIG. 1.

Referring to FIG. 7, a partial top elevation view of the armor system 100 is shown. In particular, interfacing between the control subsystem 120/controller 150 and the first hanger subassembly 110 (e.g., first hanger subassemblies 110*a*, 110*b*, . . . , 110*n*) is illustrated. Each first hanger subassembly 110 is mechanically coupled with (i.e., in correspondence with) a respective strand 102.

Each first hanger subassembly 110 comprises the actuator driver 164 (e.g., actuator drivers 164*a*, 164*b*, . . . , 164*n*) and the operating linkage 166 (e.g., operating linkages 166*a*, 166*b*, . . . , 166*n*). The operating linkage 166 is coupled to and actuated via the actuator driver 164 to provide motion to the first hanger subassembly 110 and thus to the strand 102 in response to control signals that are communicated from the control subsystem 120 via the connector subsystem 160 to the hanger subassembly 110. The operating linkage 166 may be implemented as a lever arm, scissors mechanism, 4-bar linkage, parallelogram linkage, and the like to meet the design criteria of a particular application. As described in more detail in connection with FIGS. 13, 14, 15(A-h), and 16(A-K), the motion provided to the strand 102 via the first hanger subassembly 110 may be linear (e.g., back and forth, push and pull) and/or rotational (e.g., angular, clockwise/counterclockwise) and may generate a variety of induced (activated) motions (e.g., waves, whip-like, slithering, etc.). The second hanger subassembly 110, when implemented, is generally implemented similarly to the first hanger subassembly 110.

The mechanical coupling and tensioning of the strand 102 to the first hanger subassembly 110 and the second hanger subassembly 110, when implemented, may be maintained via tensioning as provided via gravitational force and/or via mechanisms that may be implemented as described, for example, in U.S. Pat. No. 3,416,051, issued Dec. 10, 1968 to Pinto, et al., which is incorporated by reference in its entirety. However, the mechanical coupling and tensioning of the strand 102 via the control system 120 may be implemented via any appropriate apparatus and control to meet the design criteria of a particular application as would be known to one of skill in the art.

Figure 8:
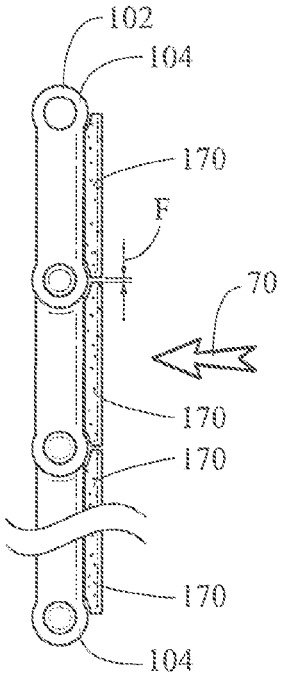
Figure 9:
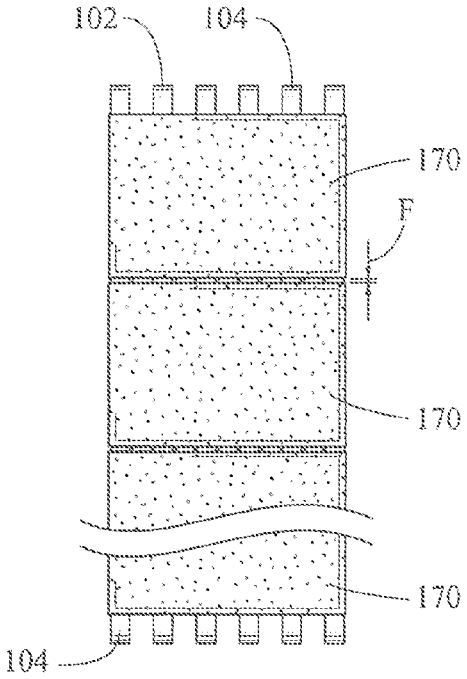
FIG. 9 is a right side elevation view that illustrates an individual strand of the armor system of FIG. 1.

Referring to FIGS. 8 and 9, edge and side views, respectively, of an individual strand 102 are shown. While the link 104 may be implemented as standalone, monolithic armor/structural material, in alternative embodiments, any type of armor material appliqué or coating (e.g., paint, anodize, physical vapor deposition, sputter, and the like) may be applied to enhance link 104 physical properties (e.g., ballistic, structural, reliability, durability, environmental, corrosive resistance, maintainability, etc.). The MAAL strand 102 is shown with the material appliqué 170 added to the link 104. The plate 170 is generally implemented as an armor material such as steel, titanium, aluminum, composite, cermet, ceramic, and the like. The plates 170 are generally separated from each other by the flexation separation distance, F, that is selected to be small enough to provide threat protection while maintaining desired angular range for the rotation, R.

The plate 170 may be attached (i.e., bonded, fastened, adhered, affixed, molded onto, connected, and the like) to the link 104 via techniques as described, for example, in U.S. Pat. No. 5,482,365, issued Jan. 9, 1996 to Peterson, et al.; U.S. Pat. No. 6,080,493, issued Jun. 27, 200 to Kent; and U.S. Pat. No. 6,460,945, issued Oct. 8, 2002 to Takeno, et al., all of which are incorporated by reference in their entirety, or, alternatively, by any appropriate bonding technique to meet the design criteria of a particular application as would be known to one of skill in the art.

The armor system 100 is generally positioned on the vehicle 50 such that the threat 70 is intercepted by the plate 170. The face of the plate 170 that is impacted by the threat 70 is a strike face.

Figure 10:
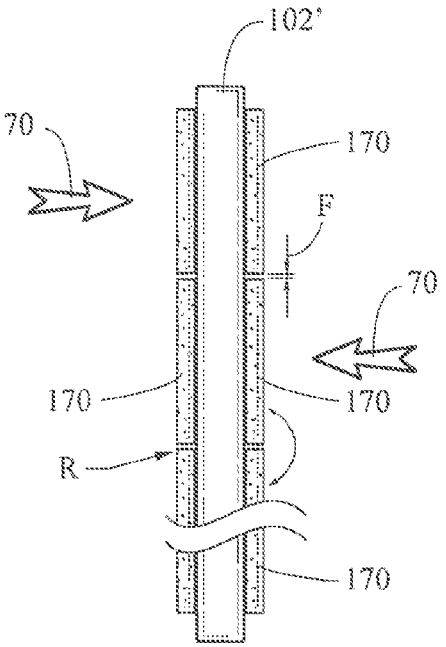
FIG. 10 is an edge view of an alternative embodiment of the Individual strand of the armor system of FIG. 1.
Figure 11:
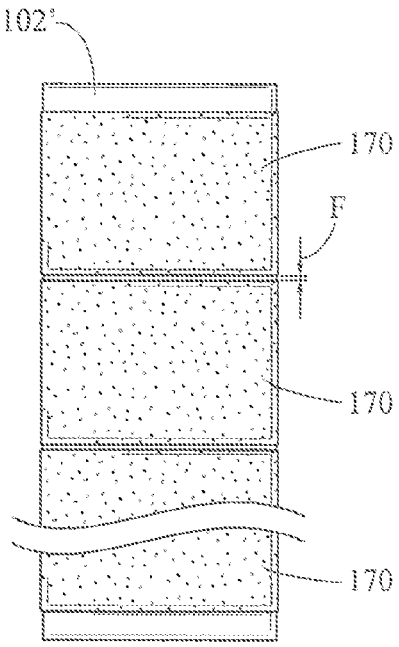
FIG. 11 is a side view of an alternative embodiment of the individual strand of the armor system of FIG. 1.

Referring to FIGS. 10 and 11, edge and side views, respectively, of an alternative embodiment of the individual strand 102 (i.e., strand 102') are shown. In lieu of a plurality of the link 104 connected via the axle 106, a belt 102' may be implemented to provide the robust flexible structure of the strand 102. The belt 102' may be implemented as wire mesh, metallic chain mail, rubber, fiber weave, or any other high tensile strength, pliable material that provides similar passive dynamic deflection. The strand 102' may be implemented similar to the techniques described, for example, in U.S. Pat. No. 2,723,214, issued November 1955 to Meyer; U.S. Pat. No. 3,813,281, issued May 28, 1974 to Burgess, et al.; and U.S. Pat. No. 4,356,569, issued Nov. 24, 1980 to Sullivan, all of which are incorporated by reference in their entirety. However, the strand 102' may be implemented via any appropriate process and compositions to meet the design criteria of a particular application as would be known to one of skill in the art.

The MAAL strand 102' is shown with the material appliqué 170 bonded to the belt 102' on both sides. In an alternative embodiment of the MAAL strand 102', the material appliqué 170 may be bonded to the belt 102' only to the side of the belt 102' that is expected to intercept the threat 70. The plate 170 may be attached to the belt 102' via techniques similarly to the attachment to the link 104 described above, or, alternatively, by any appropriate bonding technique to meet the design criteria of a particular application as would be known to one of skill in the art. In the discussions herein, the implementation of the strand 102 is generally also applicable to implementations of the strand 102'.

Figure 12:
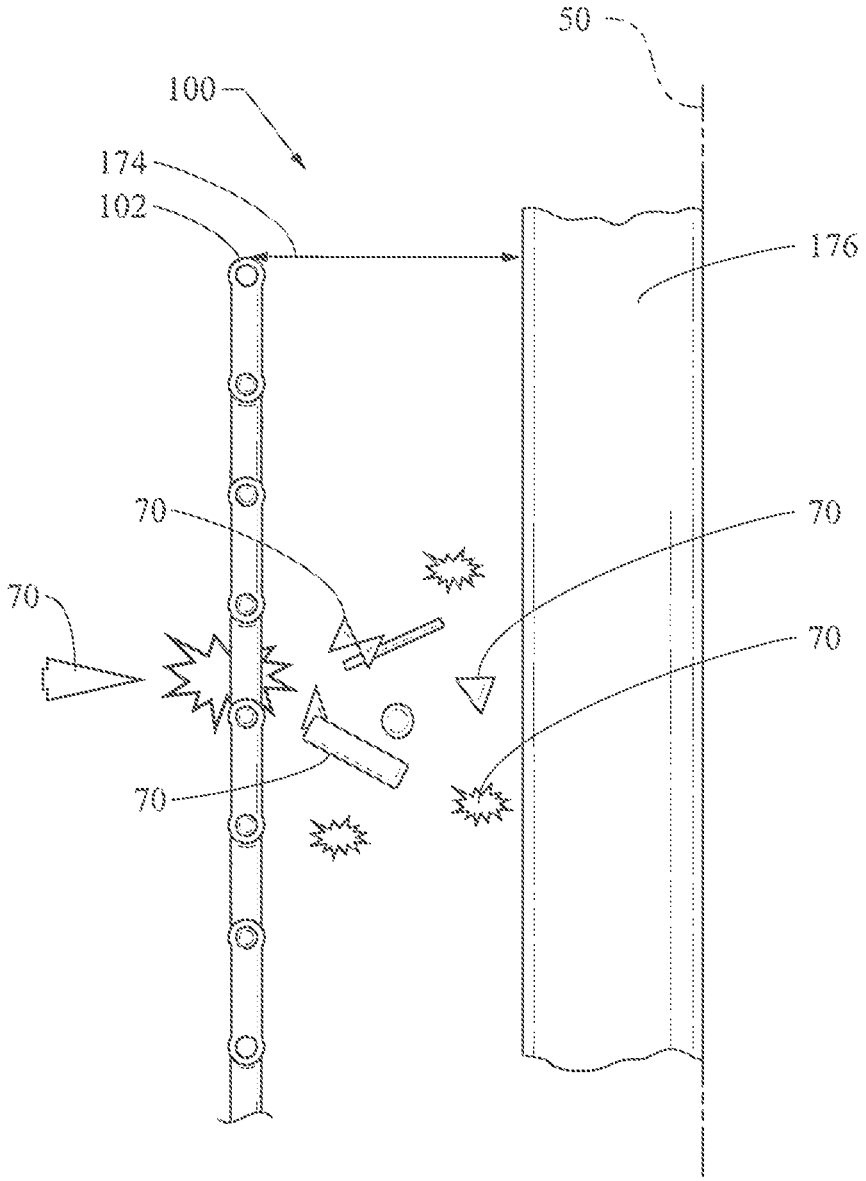
FIG. 12 is an end view from the front to the rear of a portion of an alternative embodiment of the armor system of FIG. 1 installed on the vehicle.

Referring to FIG. 12, an end view of an alternative embodiment of the armor system 100 shown. The hanger subsystem 110 is not shown for clarity of illustration. The strand (curtain) 102 is generally implemented distal (e.g., outward of) the vehicle 50. The armor system 100 may further comprise either or both of the drift gap 174 and the spall catcher 176 in the space (void) between the vehicle 50 and the strand 102. Upon impingement of the threat 70 at the strand 102, the threat 70 is disrupted (e.g., deflected, broken into particles, distorted, deformed, etc.). The drift gap 174 and the spall catcher 176 generally enhance performance of the armor system 100 by providing volume for the disrupted threat 70 to disperse and dissipate (e.g., absorb) the associated residual kinetic energy.

The spall catcher 176 generally comprises a material such as urethane foam; polystyrene foam; a fibrous material such as felt, multi-filament yarn, woven nylon, woven para-aramid; and the like. The spall catcher 176 may be mounted on the surface of the vehicle 50. The combined thicknesses of the drift gap 174 and the spall catcher 176 (i.e., distance between the vehicle 50 and the strand 102) in connection with the strand/curtain 102 is generally selected to provide effective defeat of the threat 70. For most applications the combined thicknesses of the drift gap 174 and the spall catcher 176 is at least three inches and less than twenty five inches, and typically in the range of four inches to ten inches.

Figure 13:
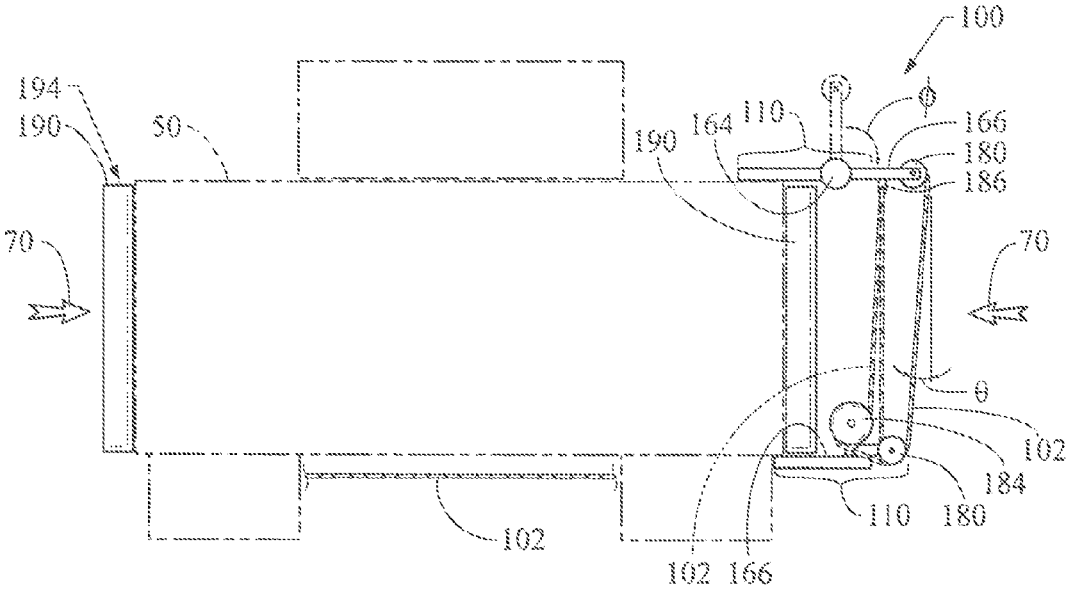
FIG. 13 is an end view from the rear to the front of an alternative embodiment of the armor system of FIG. 1 installed on the vehicle.

Referring to FIG. 13, an end view from the rear of an alternative embodiment of the armor system 100 installed on the vehicle 50 shown. As noted above, the user may manually operate the control system 120 to adjust the configuration of the armor system 100 via the user operated input/output and display console 152. The control subsystem 120, generally automatically, in real time adjusts the configuration of the armor system 100 in response to the threat 70 as detected via the sensors 154 via controlled movement of the actuator subsystem 156. The actuator subsystem 156 is generally mechanically (including hydraulically and/or pneumatically), magnetically, and/or electrically coupled to the first hanger support subsystem 110, and to the second hanger support subsystem 110, when implemented. An example embodiment of an implementation the armor system 100 that shows the tractability and conformability is illustrated on FIG. 13.

The strand 102 may be suspended via one or more of the idler pulleys 180. Additional length of the strand 102 may be stored on and deployed from the spool 184 to provide replacement for damaged strand 102 and/or to provide slack to the strand 102 such that variable motion of the strand 102 may be implemented. The motion of the strand 102 may be generated by impingement of the threat 70, and/or by manual or automatic control of the army system 100 via the control subsystem 120. Different applications of the armor system 100 include the use of various mounting and attachment structures 110 and the actuator subsystem 156 at various areas of the vehicle and/or structure 50. For example, the attachment and mounting schemes 156 can be varied, adjustable, and dimensionally tractable and conformable to accommodate the threat 70 hazards. The curtain 102 may also be implemented on the underside of the vehicle 50.

The spooled storage and deployment of the curtain 102 may be implemented similarly to the systems described in U.S. Pat. No. 1,119,200, issued Dec. 1, 1914 to Stofa; U.S. Pat. No. 6,240,997, issued Jun. 5, 2001 to Lee; and U.S. Pat. No. 6,588,705, issued Jul. 8, 2003 to Frank, all of which are incorporated by reference in their entirety. However, the spooled storage and deployment of the curtain 102 via the control system 120 may be implemented via any appropriate apparatus and control to meet the design criteria of a particular application as would be known to one of skill in the art. Further, the spooled storage and multiple deployment schemes of the curtain 102 may be performed manually by the user, without incorporation of the control system 120.

The operating linkage 166 may be controlled (e.g., actuated by the actuator drive 164) to move through the rotational angular range, φ, which will generally produce the vertical angular displacement, θ, to the screen 102. As illustrated in phantom, one or more additional layers of the strand 102 may be implemented (e.g., suspended via the hanger 186) to provide added protection. The multiple layers of the strand 102 may be generated by looping a single strand 102 and/or by providing additional separate strands 102.

The armor system 100 may further comprise one or more of the open-top containers 190. The containers 190 are generally attached (i.e., fixed, fastened, mounted, installed, etc.) at at least one of the sides and/or top of the vehicle hull 50. As described below in connection with FIGS. 17, 18, and 19(A-H), the strand/curtain 102 is generally filled (loaded) into and emptied (unloaded) from the container 190 via the open top region 194. The container 190 may provide lateral stability to the strand/curtain 102 in lieu of implementation of the second hanger subsystem 110. The container 190 may provide a structure that folds (thickens) the strand/curtain 102 and thereby provides additional protection against the threat 70.

Figure 14:
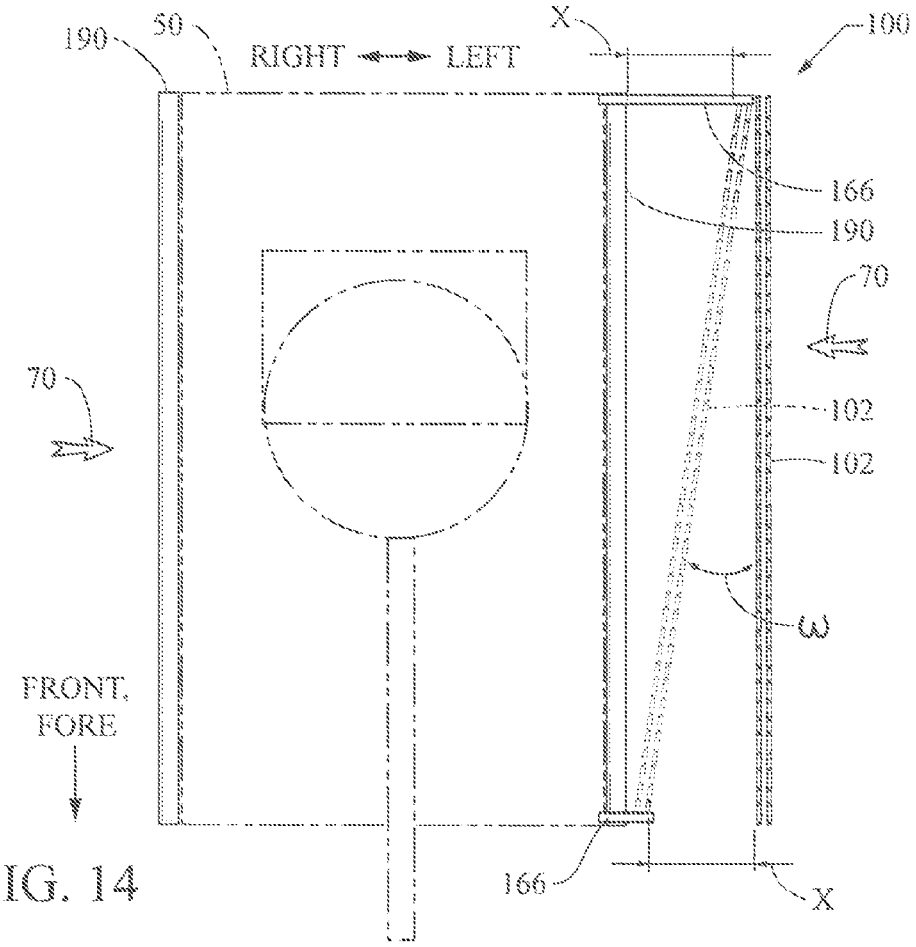
FIG. 14 is a top elevation view of the armor system of FIG. 1 mounted on the vehicle.

Referring to FIG. 14, a top elevation view of the armor system 100 mounted on the vehicle 50 is shown. The operating linkage 166 may be controlled (e.g., actuated by the actuator drive 164) to move through a substantially linear displacement (e.g., range of motion), X, which will generally produce the angular displacement, w, to the screen 102. While the armor system 100 is illustrated showing the motion of two implementations (i.e., fore and aft on the vehicle 50) of the operating linkage 166, the angular displacement, w, of the screen 102 may be adjusted via a single implementation of the actuator subsystem 156.

The armor system 100 generally adjusts the linear displacement X and the angular displacements φ, θ, and ω of the strand/curtain 102 (i.e., the obliquity with respect to the approach of the threat 70) manually and/or automatically, dynamically, in real time via the control subsystem 120 in connection with the hanger subsystem 110. The armor system 100 also may provide adjustment to the dynamic behavior (e.g., morphology) of the strand 102.

Figure 15A:
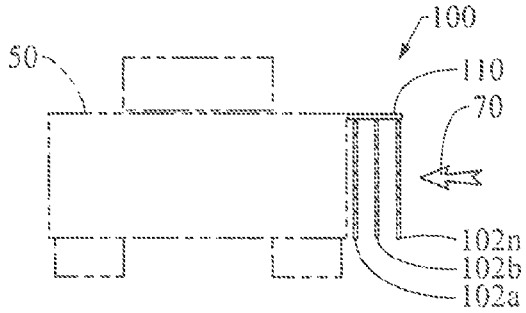
FIGS. 15(A-H) are a series of views illustrating alternative embodiments of the armor system of FIG. 1 as installed on the vehicle, wherein FIGS. 15(A-G) are end views from the rear to the front of alternative embodiments of the armor system of FIG. 1 installed on the vehicle.
FIG. 15H is a top elevation view of the armor system of FIG. 1 mounted on the vehicle.
Figure 15E:
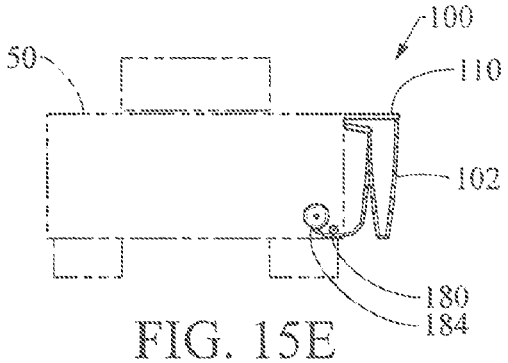
Figure 15B:
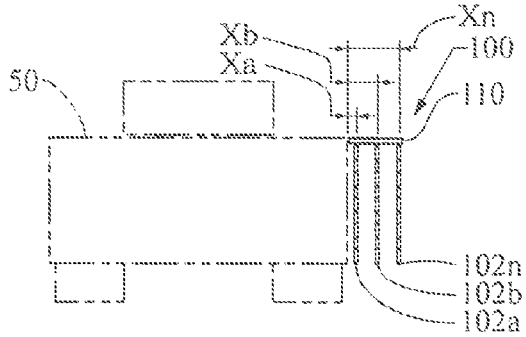
Figure 15F:
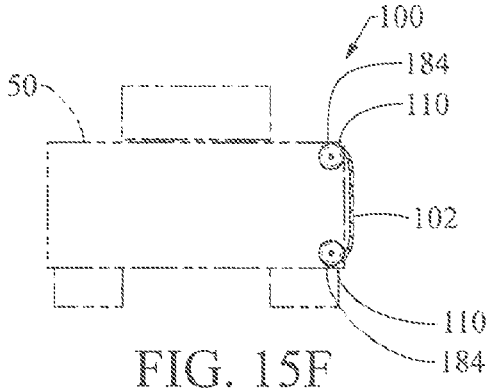
Figure 15C:
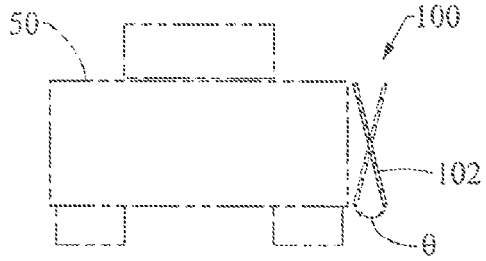
Figure 15G:
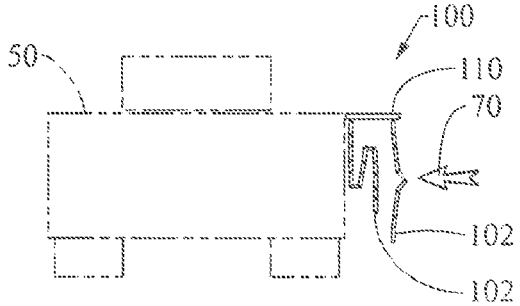
Figure 15D:
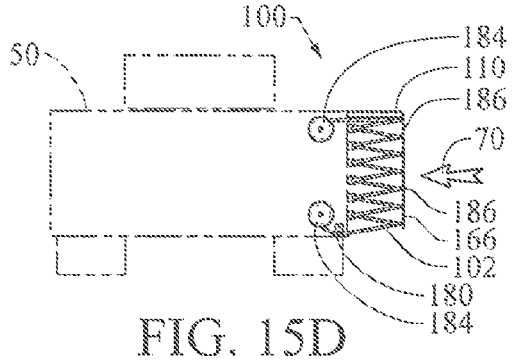
Figure 15H:
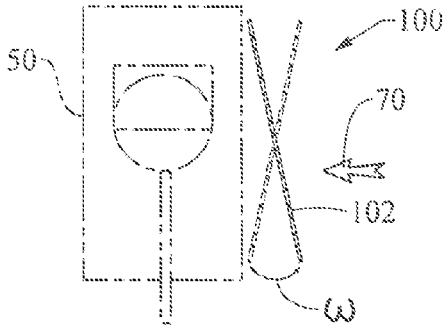

Referring to FIGS. 15A-15H, examples of alternative embodiments of the armor system 100 and modes of operation thereof are shown. FIGS. 15(A-G) are end views from the rear to the front of alternative embodiments of the armor system 100 installed on the vehicle 50, and FIG. 15H is a top elevation view of the armor system 100 mounted on the vehicle 50. FIG. 15A illustrates a plurality of the strands/curtains 102 (e.g., the strands 102*a*, 102*b*, and 102*n*) hanging substantially, vertically suspended at the top (e.g., at the first end) via the support subsystem 110, and freely movable in the vertical and lateral directions at the bottom (e.g., at the second end); and substantially equidistant from each other in the lateral direction.

FIG. 15B illustrates a plurality of the strands/curtains 102 (e.g., the strands 102*a*, 102*b*, and 102*n*) hanging substantially, vertically suspended at the top (e.g., at the first end) via the support subsystem 110, and freely movable in the vertical and lateral directions at the bottom (e.g., at the second end), wherein the strands 102 are spaced outward from the vehicle 50 at differing distances (i.e., adaptable standoff). E.g., the strand/curtain 102*a* may extend a distance Xa to the right, distal from the outer surface of the vehicle 50; the strand/curtain 102*b* may extend a distance Xb to the right, distal from the outer surface of the vehicle 50, where Xb>Xa; and the strand/curtain 102*n* may extend a distance Xn to the right, distal from the outer surface of the vehicle 50, where Xn>Xb.

FIG. 15C illustrates an embodiment of the armor system 100 adaptability via the longitudinal axis obliquity adjustment capability of the strand 102 through the angle, θ, similar to the illustration shown on FIG. 13. The hanger subsystem 110 is not shown for clarity of illustration.

FIG. 15D Illustrates an embodiment of the armor system 100 wherein, the strand curtain 102 is installed via combination of the operating linkage 166, the idler pulleys 180, the spool, and the hanger 186 to provide a high degree of topographical morphology to the strand/curtain 102. A multi-fold, accordion shape (when view from either end of the vehicle 50) may be implemented with the strand 102 such that the threat 70 may be more effectively be defeated. In particular, when the threat 70 is a so-called rocket propelled grenade (RPG), the accordion shaped strand 102 generally will intercept and defeat the fusing and/or shaped charge performance operation of the RPG threat 70 (shown in more detail on FIG. 16I).

FIG. 15E illustrates a progressively scaled embodiment of the folded, overlap of the strand 102 similar to the illustration shown on FIG. 13.

FIG. 15F illustrates an embodiment of the armor system 102 wherein the strand 102 is installed having the spool 180 at both the first end and the second end, and the curtain 102 is retracted substantially flush to the outer surface of the vehicle 50 such that the external profile of the vehicle 50 with the armor system 100 is minimized (e.g., to aid storage, maneuverability, and transport).

FIG. 15G illustrates an embodiment of the armor system 102 wherein the control subsystem 120 substantially simultaneously activates (induces, produces, generates) wave motion to multiple implementations of the strand 102. The wave motion generally provides another topographical morphology to the strand/curtain 102.

To induce the wave shape motions on the strand/curtain 102, the actuator driver 164 apparatus section of the hanger subsystem 110 may include wave vibration generation devices. Examples of conventional wave vibration generation apparatuses that may be implemented in connection with the control assembly 120 may be found, for example, in U.S. Pat. No. 4,383,585, issued May 17, 1983 to Gaus; U.S. Pat. No. 4,580,073, issued Apr. 1, 1986 to Okumura et al.; and U.S. Pat. No. 5,435,195, issued Jul. 25, 1995 to Meier, all of which are incorporated by reference in their entirety; however, the wave vibration generation device of the hanger subsystem 110 may be implemented via any appropriate apparatus to meet the design criteria of a particular application as would be known to one of skill in the art.

FIG. 15H illustrates a top view of the armor system 100 installed on the vehicle 50 wherein an embodiment of the armor system 100 adaptability via the latitudinal axis obliquity adjustment capability of the strand 102 through the angle, w, similar to the illustration shown on FIG. 14. The hanger subsystem 110 is not shown for clarity of illustration.

Referring to FIGS. 16(A-K), edge views of alternative embodiments of the armor system 100 and the threat 70 at various instances in time are shown. As such, FIGS. 16(A-K) illustrate advantageous terminal ballistic reduction effects provided by the armor system 100 including but not limited to: tension to the strand 102 combined with a tumble and/or yaw effect to the threat 70; mass accumulation (increase) of the strand 102 at the point of impact of the threat 70 and along the strand 102; and passive, dynamic deflection of the threat 70. As previously noted, the armor system 100 may provide additional disruption, destruction, capture, distortion, and/or deflection of the threat 70.

Figure 16A:
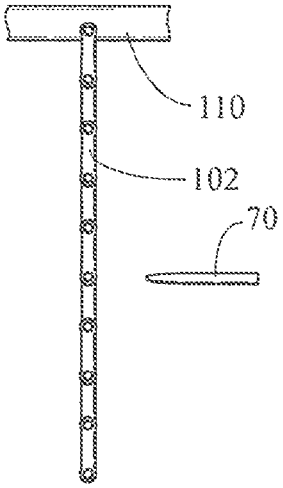
FIGS. 16(A-K) are edge views of embodiments of the armor system of FIG. 1 and the threat at various instances in time.
Figure 16B:
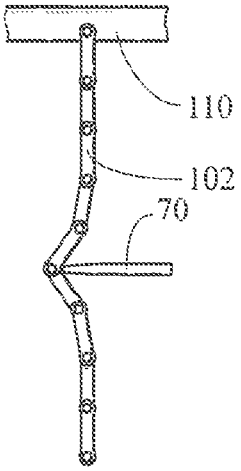
Figure 16C:
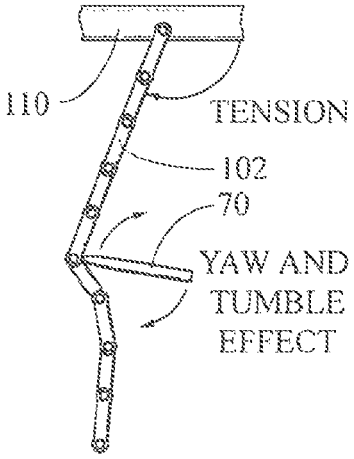

Referring to FIGS. 16A-16C, the approach and impact of the threat 70 to the strand/curtain 102 is shown, wherein the strand/curtain 102 is illustrated in connection with an implementation similar to the embodiment of the armor system 100 illustrated, for example, on FIGS. 15A and 15B. On FIG. 16A, the threat 70 is illustrated approaching the strand/curtain 102. On FIG. 16B, the threat 70 is illustrated impacting the strand/curtain 102, and mass accumulation of the strand/curtain 102 is initiated. On FIG. 16C, the threat 70 is becoming entangled in the strand/curtain 102, mass accumulation of the strand/curtain 102 is increasing, tension is provided along the strand/curtain 102, and the projectile 70 is urged into yaw and tumble motion, thus reducing or eliminating the potential penetration effect of the threat 70.

Figure 16D:
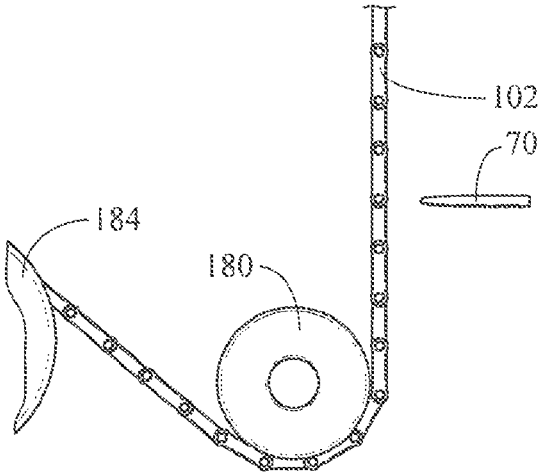
Figure 16E:
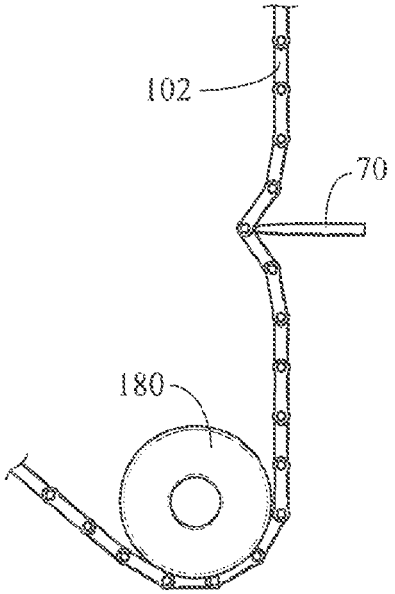
Figure 16F:
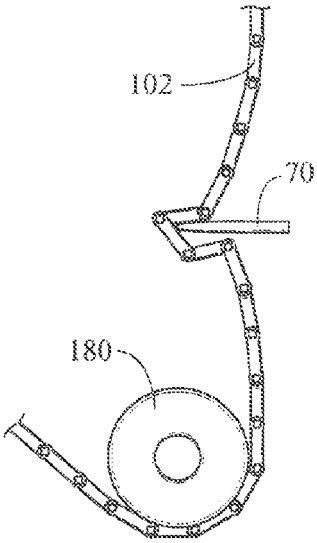

On FIGS. 16D-16F, the approach and impact of the threat 70 to the strand/curtain 102 is shown, wherein the strand/curtain 102 is illustrated in connection with an implementation of the armor system 100 similar to the embodiment illustrated, for example, on FIGS. 13 and 15D. On FIG. 16D, the threat 70 is illustrated approaching the strand/curtain 102. On FIG. 16E, the threat 70 is illustrated impacting the strand/curtain 102, and mass accumulation of the strand/curtain 102 is initiated. On FIG. 16F, the threat 70 is becoming entangled in the strand/curtain 102, mass accumulation of the strand/curtain 102 is increasing, and tension is provided along the strand/curtain 102.

Figure 16G:
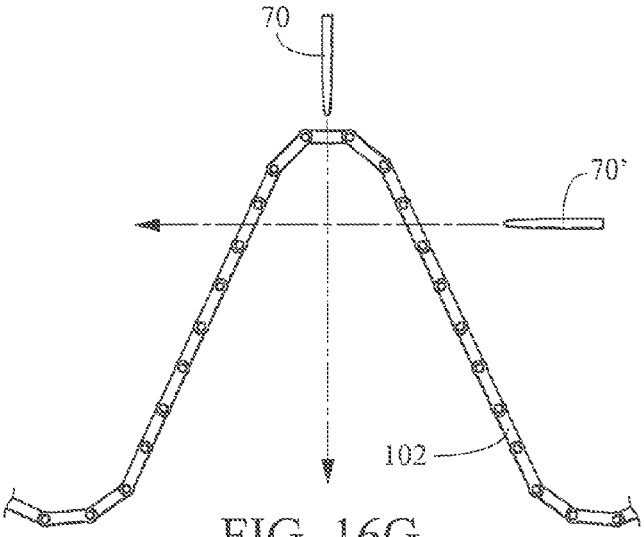

On FIGS. 16G-16I, the strand/curtain 102 is configured by an activated (induced) wave form via operation of the control subsystem 120 as previously illustrated on and described in connection with FIG. 15G. As illustrated on FIG. 16G, when the threat 70 impacts an apex of the wave-shaped strand 102, a larger number of links 104 are encountered than when a substantially straight section of the strand 102 is impacted (for example, as illustrated on FIGS. 16A-16C). As such, the wave shaped configuration generally provides increased standoff from the environment 50 at the point where the threat 70 impacts the strand/curtain 102. Further, when the threat 70' impacts a section of the wave-shaped strand 102 that is overlapped, a larger number of links 104 are encountered than when a substantially straight section of the strand 102 is impacted.

Figure 16H:
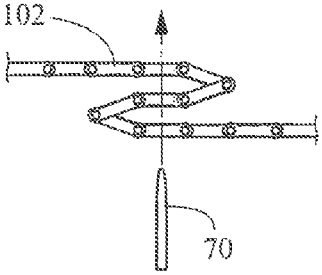
Figure 16I:
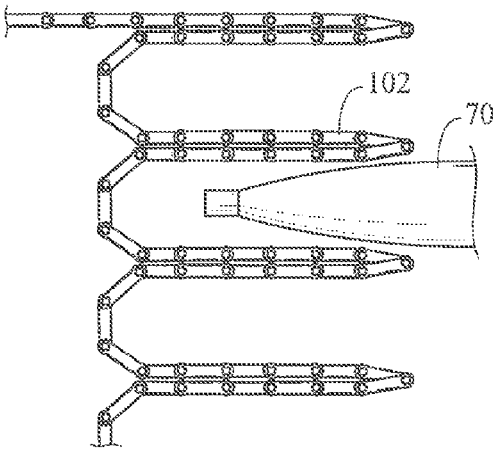

On FIG. 16H, the threat 70 is illustrated approaching impact to a multiple layered, overlapped, wave shaped section of the strand 102 which provides further mass accumulation. As illustrated on FIG. 16I, the accordion shaped strand 102 generally will intercept and defeat the fusing and/or shaped charge performance operation of the RPG threat 70. The multi-layer and/or folded/wave-shaped implementations of the strand/curtain 102 may also advantageously provide improved heat signature management when compared to conventional armor implementations.

Figure 16J:
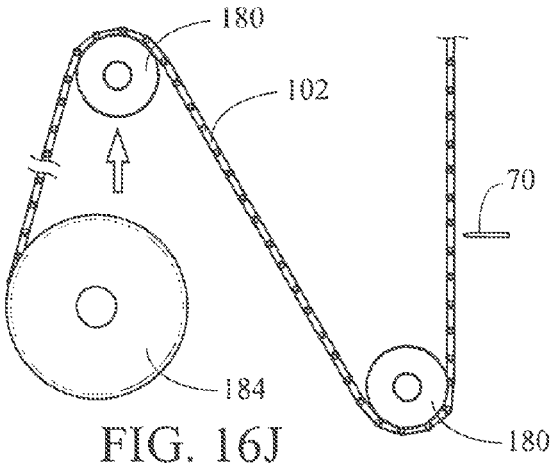
Figure 16K:
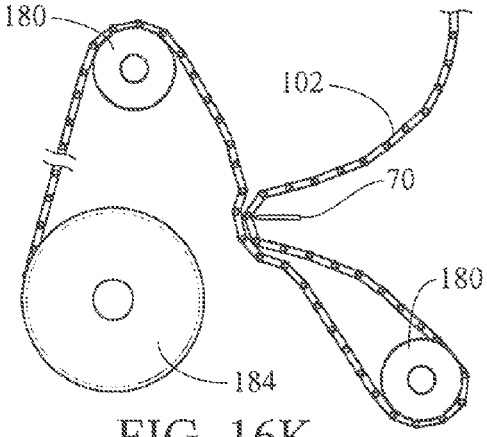

FIGS. 16J and 16K illustrate the reaction of an embodiment of the armor system 100 in response to the threat 70. On FIG. 16J, the strand 102 presents a three layer overlap between two of the pulleys 180 and the spool 184 to the approaching threat 70. As illustrated on FIG. 16K, the flexible, conformable, topographically enhanced strike face, triple layered defeat structure produces mass accumulation, dynamic dimensional adaptability, and passive dynamic deflection to the threat 70 which generally increases the armor system 100 ballistic threat defeat capability.

Figure 17:
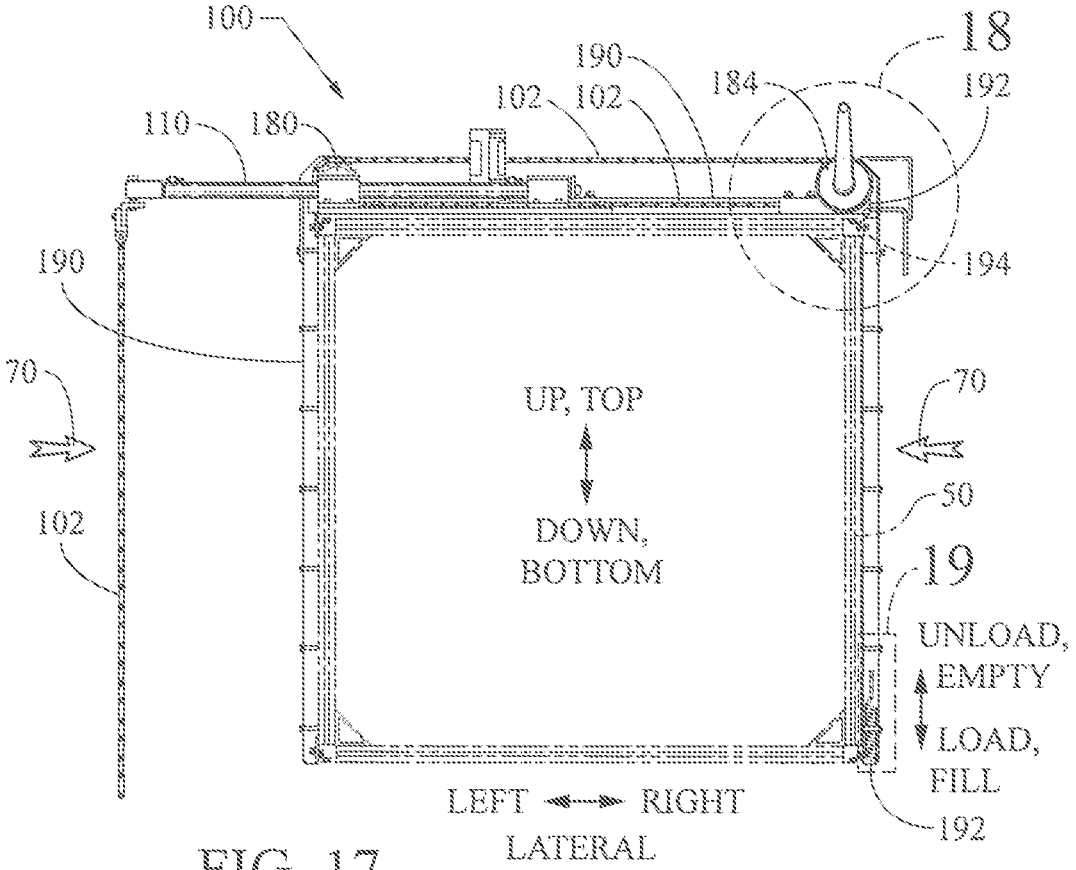
FIG. 17 is an end view from the rear to the front of another alternative embodiment of the armor system of FIG. 1 installed on the vehicle.
Figure 18:
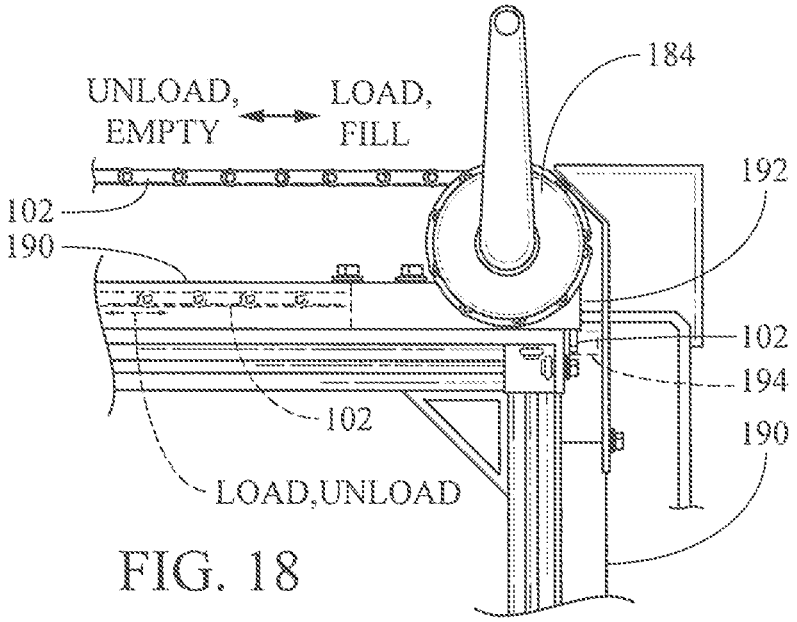
FIG. 18 is a broken out section of the armor system of FIG. 17.

Referring to FIG. 17, an end view (e.g., a rear view similar to FIGS. 13 and 15(A-G) of the vehicle 50 having an alternative embodiment of the armor system 100 is illustrated. FIG. 17 includes cutout views that illustrate internal views of the container 190 and contents therein at the container bottom 192 and at the top region 194. Note that the container 190 is shown Installed on the top of the hull 50 as well as both sides. FIGS. 18 and 19(A-H) illustrate the cutout views in greater detail. The strand/curtain 102 may be deployed in a folded layer across the top of the vehicle hull 50, and loaded (filled) into and unloaded (emptied, retrieved) from the open-top container 190 via implementation of the spool mechanism 184 and other components of the hanger subsystem 110 in response to the control subsystem 120.

FIG. 18 illustrates an enlarged view of the portion 18 on FIG. 17. The strand/curtain 102 is shown in more detail in connection with the load/unload processes.

Figures 19A, 19B, 19C, 19D:
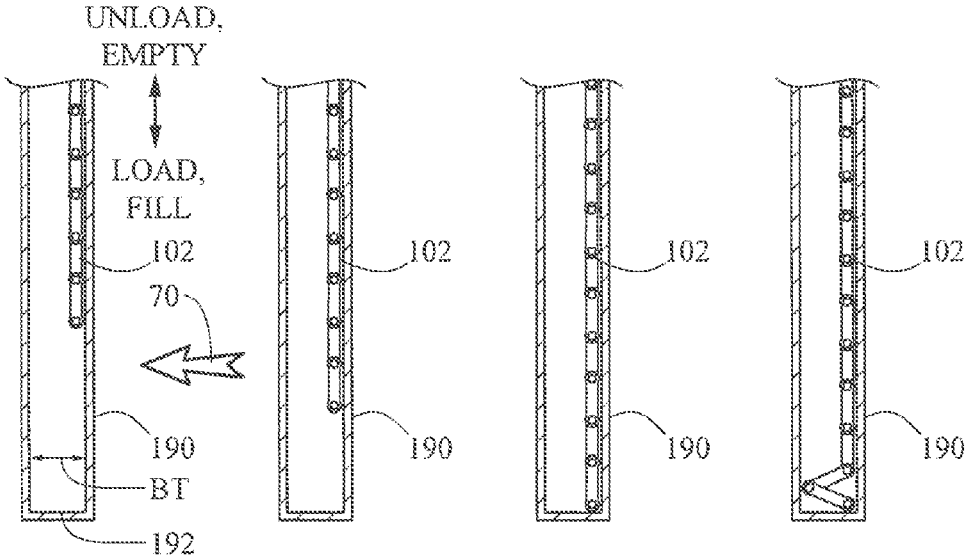
FIGS. 19(A-H) are time lapse views of a broken out section of the armor system of FIG. 17.
Figures 19E, 19F, 19G, 19H:
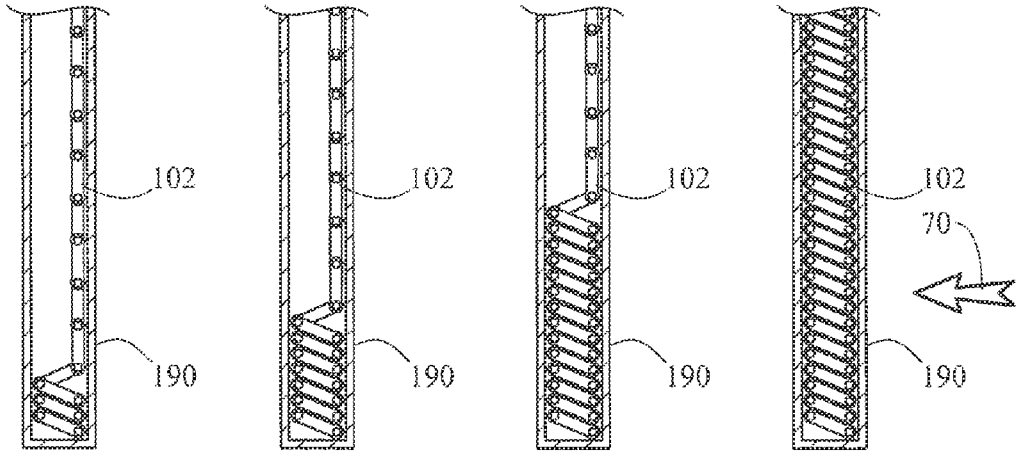

FIGS. 19(A-H) illustrate a series of time lapse views of the strand/curtain 102 during a load (e.g., deploy, feed, fill) process into the open-top container 190. At the start time of the loading (FIG. 19A), the strand/curtain 102 is illustrated entering into the container 190 via the open top region 104. When the strand/curtain 102 reaches the bottom 194, the strand/curtain 102 begins to overlap onto itself (FIG. 19D). The overlap of the links 104 generally proceeds as the load process continues until the container 190 is substantially full (FIGS. 19E-19H). During an unload (e.g., retrieval, empty) process, the strand/curtain 102 generally is moved in the reverse direction, as would be understood by one of skill in the art.

The internal box thickness BT is generally selected (i.e., determined, chosen, calculated, or the like) such that links 104 are constrained to fold into a snugly overlapped position in a stack, wherein adjacent links 104 rest atop one another while excess to the box thickness BT is generally avoided. As such, the box thickness BT is generally in a range greater than the overall link length L, and less than twice the overall link length L.

While the invention may have been described with reference to certain embodiments, numerous changes, alterations and modifications to the described embodiments are possible without departing from the spirit and scope of the Invention as defined in the appended claims, and equivalents thereof.

What is claimed is:

1. An armor system for the protection of an environment (50), the armor system comprising:

at least one flexible strand (102), wherein the flexible strand comprises a first end, a second end, and a strike face;

a first strand support subsystem (110) mounted to the environment and comprising at least one of an idler pulley (180) and a spool (184), wherein the first strand support subsystem retains the first end of the strand, and the flexible strand is configured to intercept a ballistic threat (70) at the strike face;

a control subsystem (120) coupled to the first strand support subsystem and configured to manually or automatically adapt the configuration of the armor system in response to the ballistic threat; and an open-top container (190), wherein the open-top container is mounted to the environment and has a closed bottom (192), an open top region (194), and an internal box thickness (BT);

wherein, the flexible strand is deployed into the open-top container via the open top region, and when the second end of the flexible strand encounters the closed bottom, the flexible strand folds upon itself to an accordion shape as constrained by the internal box thickness.

2. The armor system of claim 1, wherein the armor system further comprises at least one of a drift gap (174) and a spall catcher (176) positioned between the flexible strand and the environment where the armor system is implemented.

3. The armor system of claim 1 wherein, the flexible strand comprises at least one of a roller, leaf, or hinge link chain or a flexible belt having at least one armor plate (170) that is attached to the flexible belt.

4. The armor system of claim 1 wherein, the armor system further comprises a second strand support subsystem mounted to the environment, wherein the second strand support subsystem retains the second end of the flexible strand.

5. The armor system of claim 4, wherein the control subsystem (120) is further coupled to the second strand support subsystem.

6. The armor system of claim 1, wherein the configuration of the armor system includes activating a wave shape along the flexible strand.

7. The armor system of claim 1, wherein the flexible strand is looped around the at least one of the idler pulley and the spool to present two or more layers to the threat.

8. A method for defeating a ballistic threat, the method comprising:

attaching a first strand support system (110) to an environment (50) to be protected, the first strand support system comprising at least one of an idler pulley (180) and a spool (184); and operating the first strand support system to retain at least one flexible strand (102) at a first end thereof to provide an armor system, wherein the flexible strand further comprises a second end, and a strike face; and, wherein the flexible strand is configured to intercept a ballistic threat (70) at the strike face;

wherein the armor system further comprises a control subsystem (120) that is coupled to the first strand support subsystem, and the control subsystem configured to manually or automatically adapt the configuration of the armor system in response to the ballistic threat; and wherein the armor system further comprises an open-top container (190) mounted to the environment and having a closed bottom (192), an open top region (194), and an internal box thickness (BT); wherein, the flexible strand is deployed into the open-top container via the open top region, and when the second end of the flexible strand encounters the closed bottom, the flexible strand folds upon itself to an accordion shape as constrained by the internal box thickness.

9. The method of claim 8, wherein the armor system further comprises at least one of a drift gap (174) and a spall catcher (176) positioned between the flexible strand and the environment.

10. The method of claim 8 wherein, the flexible strand comprises at least one of a roller, leaf, or hinge link chain or a flexible belt having at least one armor plate (170) that is attached to the flexible belt.

11. The method of claim 8 wherein, the armor system further comprises a second strand support subsystem that is mounted to the environment, wherein the second strand support subsystem retains the second end of the flexible strand.

12. The method of claim 11, wherein the control subsystem (120) is further coupled to the second strand support subsystem.

13. The method of claim 8, wherein the configuration includes activating a wave shape along the flexible strand.

14. The method of claim 8, wherein the flexible strand is looped around the at least one of the idler pulley and the spool to present two or more layers to the threat.

* * * * *